US009994946B2

(12) United States Patent
Cribb et al.

(10) Patent No.: US 9,994,946 B2
(45) Date of Patent: Jun. 12, 2018

(54) HIGH STRENGTH, HOMOGENEOUS COPPER-NICKEL-TIN ALLOY AND PRODUCTION PROCESS

(71) Applicant: Materion Corporation, Mayfield Heights, OH (US)

(72) Inventors: W. Raymond Cribb, Solon, OH (US); Fritz C. Grensing, Perrysburg, OH (US)

(73) Assignee: MATERION CORPORATION, Mayfield Heights, OH (US)

( * ) Notice: Subject to any disclaimer, the term of this patent is extended or adjusted under 35 U.S.C. 154(b) by 396 days.

(21) Appl. No.: 14/659,801

(22) Filed: Mar. 17, 2015

(65) Prior Publication Data

US 2015/0259775 A1 Sep. 17, 2015

Related U.S. Application Data

(60) Provisional application No. 61/954,084, filed on Mar. 17, 2014.

(51) Int. Cl.

| | |
|---|---|
| ***C22F 1/08*** | (2006.01) |
| ***C22C 9/06*** | (2006.01) |
| ***B22D 21/02*** | (2006.01) |
| ***B22D 18/00*** | (2006.01) |
| *C22F 1/00* | (2006.01) |

(52) U.S. Cl.

CPC ..... *C22F 1/08* (2013.01); *B22D 18/00* (2013.01); *B22D 21/025* (2013.01); *C22C 9/06* (2013.01); *C22F 1/002* (2013.01)

(58) Field of Classification Search

CPC ..... C22C 9/06; C22F 1/08; C22F 1/002

See application file for complete search history.

(56) References Cited

U.S. PATENT DOCUMENTS

| | | | | |
|---|---|---|---|---|
| 3,937,638 | A | 2/1976 | Plewes | |
| 5,198,044 | A | 3/1993 | Colijn et al. | |
| 6,148,899 | A | 11/2000 | Cornie et al. | |
| 6,648,993 | B2 * | 11/2003 | Hashiguchi | B22D 31/002 148/539 |
| 2002/0007879 | A1 | 1/2002 | Nielsen, Jr. et al. | |
| 2002/0162611 | A1 | 11/2002 | Hashiguchi | |
| 2003/0051854 | A1 | 3/2003 | Guha et al. | |
| 2007/0089816 | A1 | 4/2007 | Vincent | |
| 2012/0073712 | A1 | 3/2012 | Dewobroto et al. | |
| 2012/0145284 | A1 | 6/2012 | Ishii et al. | |

FOREIGN PATENT DOCUMENTS

| | | | |
|---|---|---|---|
| CN | 1518609 | A | 8/2004 |

OTHER PUBLICATIONS

International Search Report and Written Opinion for PCT/US2015/020900.

* cited by examiner

*Primary Examiner* — Jessee Roe

(74) *Attorney, Agent, or Firm* — Richard M. Klein; Fay Sharpe LLP

(57) ABSTRACT

A process for producing a high strength, homogeneous copper-nickel-tin alloy with high strength includes preparing a molten mixture of copper, nickel, and tin; pressure assist casting the molten mixture to form a casting; and thermally treating the casting. Novel combinations of properties can be attained for the alloy.

9 Claims, 3 Drawing Sheets

HIGH STRENGTH, HOMOGENEOUS COPPER-NICKEL-TIN ALLOY AND PRODUCTION PROCESS

CROSS-REFERENCE TO RELATED APPLICATIONS

This application claims priority to U.S. Provisional Patent Application Ser. No. 61/954,084, filed on Mar. 17, 2014, the entirety of which is incorporated by reference herein.

BACKGROUND

The present disclosure relates to copper-nickel-tin alloys and processes for producing the alloys. The alloys are homogeneous and exhibit high strength and ductility.

Copper-nickel-tin alloys exhibit very high freezing range which results in deleterious segregation and porosity in conventionally melted and cast alloys. In particular, such alloys containing from about 9 wt % to about 15 wt % nickel and from about 6 wt % to about 8 wt % tin exhibit these drawbacks.

It would be desirable to develop new homogeneous, high strength copper-nickel-tin alloys and processes for producing the alloys.

BRIEF DESCRIPTION

The present disclosure relates to copper-nickel-tin alloys and processes for producing the alloys. The alloys exhibit high strength and are homogeneous, and exhibit unique combinations of properties.

In particular embodiments, the copper-nickel-tin alloy has at least 40% ductility and a 0.2% offset yield strength of at least 25 ksi.

In other embodiments, the copper-nickel-tin alloy may have a 0.2% offset yield strength of at least 96 ksi, an ultimate tensile strength of at least 113 ksi, and ductility of at least 2%. In addition to these properties, the alloy may also have a Brinell hardness of at least 280. In specific embodiments, the alloy has a 0.2% offset yield strength of at least 100 ksi, an ultimate tensile strength of at least 120 ksi, and ductility of at least 7%, and a Brinell hardness of at least 280.

In different embodiments, a copper-nickel-tin alloy may have a 0.2% offset yield strength of at least 120 ksi.

Also disclosed herein in various embodiments are processes for producing a high strength, homogeneous copper-nickel-tin alloy. The processes include preparing a molten mixture of copper, nickel, and tin; pressure assist casting the molten mixture to form a casting; and thermally treating the casting. Pressure assist casting is distinct from traditional continuous casting (e.g., centrifugal casting) and utilizes positive or negative pressure to convey molten metal into a mold which serves to solidify the molten metal into a shaped component.

In some embodiments, the alloy contains about 8 to about 20 wt % nickel, about 5 to about 11 wt % tin, and balance copper. In particular embodiments, the alloy may include from about 9 wt % to about 15 wt % nickel and from about 6 wt % to about 8 wt % tin.

In some embodiments, the alloy can be further cast to shape the casting into a net shape or an input billet.

The molten mixture may be prepared by gathering the required metallic elements in solid form, melting the lot, and conditioning the liquid metal.

In some embodiments, thermally treating the casting comprises heating the casting at a temperature in the range of from about 1500° F. to about 1625° F. for a time period of from about 4 hours to about 24 hours.

Optionally, the process further includes spinodally hardening the casting. This can be done by solution annealing the casting, then quenching, and then spinodal decomposition by a heat treatment.

Disclosed in other embodiments are articles including a copper-nickel-tin alloy. The article is produced by preparing a molten mixture of copper, nickel, and tin; pressure assist casting the molten mixture to form a casting; homogenizing the casting; and shaping the casting to produce the article. The article may be a net-shaped article or an input billet for subsequent hot working.

The casting may be spinodally hardened.

In some embodiments, the alloy includes from about 9 wt % to about 15 wt % nickel and/or from about 6 wt % to about 8 wt % tin, the balance being copper.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
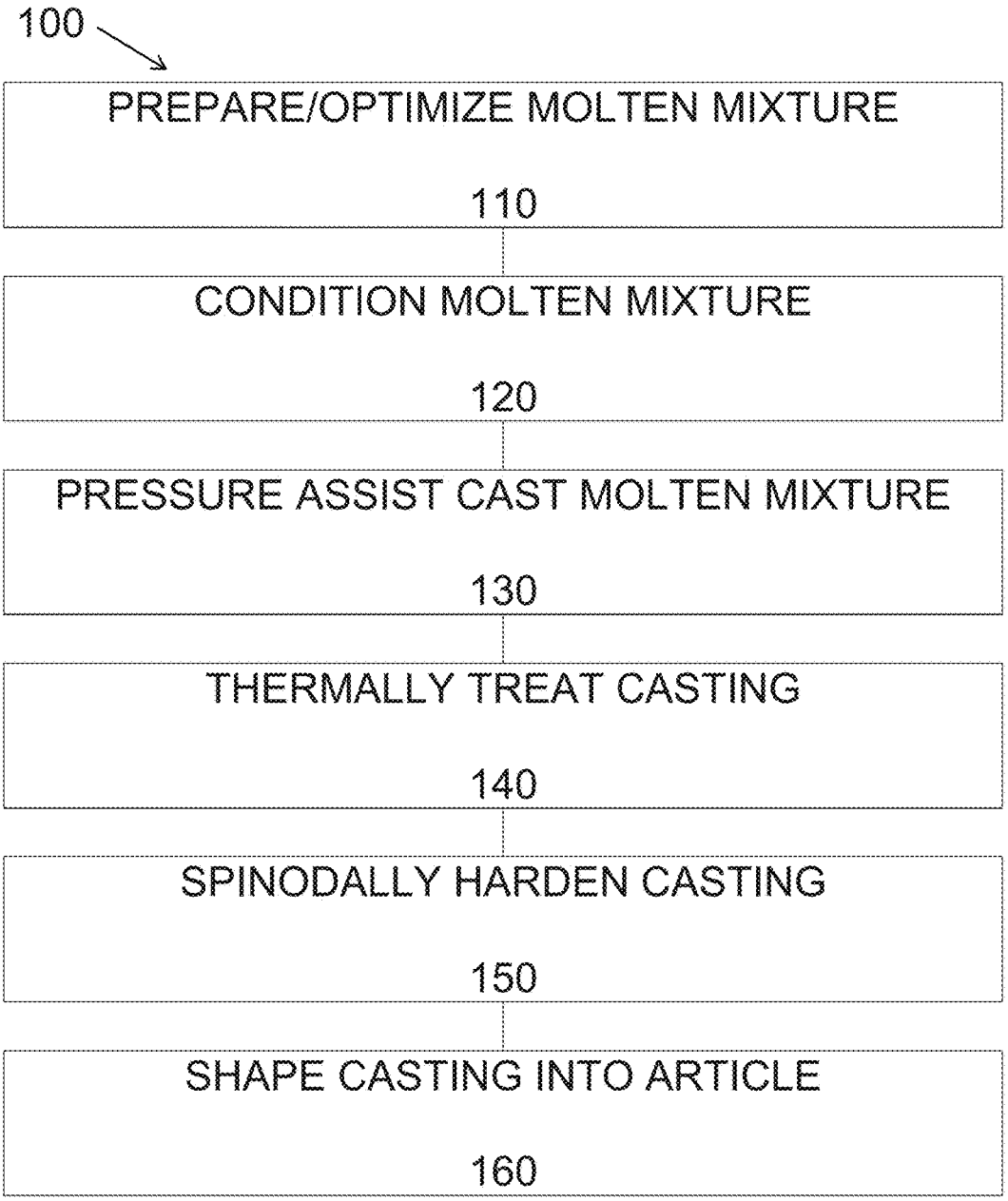
FIG. 1 is a flow chart illustrating an exemplary process of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

The present disclosure refers to temperature ranges. It is noted that these temperatures refer to the temperature of the atmosphere to which the alloy is exposed, or to which the furnace is set; the alloy itself does not necessarily reach these temperatures.

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

FIG. 1 illustrates an exemplary process of forming an article 100 according to the present disclosure. The process 100 includes preparing and optimizing a molten mixture of copper, nickel, and tin 110; optionally conditioning the molten mixture 120; pressure assist casting the molten mixture 130; thermally treating the casting 140; optionally spinodally aging the casting 150; and optionally shaping the casting into an article 160.

The preparation and optimization 110 may include gathering solid forms of copper, nickel, and tin. The solid forms may include pure elements and/or prior castings containing known amounts of copper, nickel, and tin in any combination. The melting weight or volume needed is dependent on the final castings desired and may range from small lots (e.g., 50 pounds) to large lots (e.g., thousands of pounds). Melting may be carried out in gas fired or electric furnaces which can be inerted using protective gases such as argon or carbon dioxide to protect the molten metal from oxidation.

The alloy may contain from about 9 wt % to about 15 wt % nickel and/or from about 6 wt % to about 8 wt % tin, with the balance being copper. In some embodiments, the nickel content in the alloy is from about 11 wt % to about 13 wt %, including about 12 wt %. The tin content of the alloy may be in the range of from about 6.5 wt % to about 7.5 wt %, including about 7 wt %.

In some embodiments, the alloy contains one or more other metals. The other metals may be selected from manganese, magnesium, aluminum, titanium, beryllium, calcium, and/or lithium. The alloys of the present disclosure optionally contain small amounts of additives (e.g., iron, magnesium, manganese, molybdenum, niobium, tantalum, vanadium, zirconium, and mixtures thereof). The additives may be present in amounts of up to 1 wt %, suitably up to 0.5 wt %. Furthermore, small amounts of natural impurities may be present. Small amounts of other additives may be present such as aluminum and zinc. The presence of the additional elements may have the effect of further increasing the strength of the resulting alloy.

The optional conditioning 120 may include removing dissolved oxygen by utilizing reactive metals such as manganese, magnesium, aluminum, titanium, beryllium, calcium, or similar elements that are forced into the bath and react with the oxygen to form metal oxides. The metal oxides float to the surface of the melt and can be physically removed by skimming. After oxygen is removed, hydride forming elements (e.g., lithium) can be added to the molten bath to remove hydrogen and thereby eliminate gas porosity.

Pressure assist casting 130 is distinct from traditional continuous casting (e.g., centrifugal casting). Pressure assist casting utilizes positive or negative pressure to convey molten metal into a mold which serves to solidify the molten metal into a shaped component. Casting using pressure assist casting or even pressureless casting serves to convey the liquid metal into a useful configuration, such as an engineered component or a basic shape. Depending on the end use, the alloy may be cast with or without pressure assist.

Traditionally, most metal articles are produced via molten casting (e.g., centrifugal casting) or metal forging. Typically casting is less expensive. However, centrifugal casting introduces impurities and/or porosity into the casting which degrades the structure thereof, thereby rendering centrifugal casting unsuitable for the production of articles of some dimensions and/or alloy compositions. Furthermore, segregation of the alloying components in the casting during the solidification process can cause non-uniform properties at different spatial locations in the casting. Forging may be used to produce a quality article but at relatively high costs.

In some embodiments, the pressure assist casting 130 utilizes a positive pressure to convey the molten alloy into the mold. In other embodiments, the pressure assist casting 130 utilizes a negative pressure to convey the molten alloy into the mold.

The thermal treatment 140 may be a pressure assist thermal treatment. The thermal treatment 140 is used to further reduce elemental segregation by a high temperature diffusion process. The high temperature may be in the range of from about 1400° F. to about 1800° F., including about 1500° F. to about 1625° F. The treatment may occur over a period of from about 4 hours to about 24 hours, including from about 10 hours to about 18 hours and about 14 hours.

Preferably, a high pressure inert gas is liquefied in the preferred pressure range of 5000 to 15000 psi, including from about 7500 to about 12500 psi and about 10000 psi.

Thermal treatments at high temperatures enable rapid solid state interdiffusion of microsegregated solids to form a uniform composition state. The thermal treatment may also be referred to as a homogenization treatment.

The process 100 optionally includes spinodally hardening 150 the casting. The spinodal treatment includes two steps: a solution annealing step and a subsequent spinodal decomposition strengthening step. The solution annealing step forces the elements into solid solution and enables hardening to occur during the subsequent spinodal decomposition. The solution annealing step requires exposure to temperatures in the range of about 1450° F. to about 1625° F. for times in the range of from about 1 hour to about 10 hours followed by a rapid quench, such as in ambient temperature water, which results in a soft hardenable condition. In some embodiments, the temperature is in the range of from about 1500° F. to about 1600° F. The exposure time may be in the range of from about 3 hours to about 8 hours, including from about 4 hours to about 5 hours. Finally, the cool alloy is spinodally decomposed to higher strength by holding in a temperature in the range of from about 650° F. to about 1000° F. for times in the range of from about 1 hour to about 6 hours followed by air or, optionally, water cooling. The temperature may be in the range of from about 700° F. to about 900° F., including about 825° F. The time may be in the range of from about 2 hours to about 5 hours, including from about 3 hours to about 4 hours.

The casting may further be shaped 160 into an article. The article may be useful in industries such as the aerospace industry and the medical industry. The article may be net-shaped. In some embodiments, the article is an input billet which may be subsequently hot worked.

The copper-nickel-tin alloy may be a spinodal alloy. Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

In some embodiments, the heat-treated spinodal structure retains the same geometry as the original and the articles do not distort during heat treatment as a result of the similar size of the atoms.

Copper alloys have very high electrical and thermal conductivity compared to conventional high-performance ferrous, nickel, and titanium alloys. Conventional copper alloys are typically very soft compared with these alloys and, consequently, are seldom used in demanding applications. However, copper-nickel-tin spinodal alloys combine high hardness and conductivity in both hardened cast and wrought conditions.

Furthermore, the thermal conductivity is three to five times that of conventional ferrous (tool steel) alloys, which increases heat removal rates while fostering reduction of distortion by dissipating heat more uniformly. Additionally, spinodal copper alloys exhibit superior machinability at similar hardnesses.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

These alloys can exhibit a unique combination of thermal conductivity and strength and provide many advantages in plastic tooling application such as shorter cycle times; improved plastic part dimensional control; better parting line maintenance; and excellent corrosion resistance. Such alloys can also exhibit excellent wear resistance when used for injection mold components and cavity inserts that come into direct contact with the plastic part. The copper base helps provide excellent resistance to hydrochloric acid, carbonic acid, and similar decomposition products, which may result from plastics processing. As a result, such alloys are ideal for applications involving potentially corrosive plastics. Such alloys are also readily machinable. In conventional machining operations, these alloys may provide a 1% to 25% reduction in machining time over tool steels.

In particular embodiments, the copper alloy of the present disclosure is a copper-nickel-tin alloy that contains from about 8 wt % to about 10 wt % nickel, from about 5.5 wt % to about 6.5 wt % tin, and the balance being copper. This alloy contains no beryllium and has a hardness comparable with AISI P-20 tool steel, but its thermal conductivity is two to three times higher. This alloy has excellent toughness, wear resistance, and surface finish. Table 1 describes various properties of this alloy before the alloy is processed according to the present disclosure.

TABLE 1

| Properties of copper-nickel-tin alloy | |
|---|---|
| Elastic modulus | $17.0 \times 10^6$ psi (117 GPa) |
| Density | 0.322 lb/in$^3$ (8.90 g/cm$^3$) |
| Poisson's Ratio | 0.3 |
| Thermal Conductivity at 212° F. (100° C.) | 40 BTU/hr ft ° F. (70 W/m K) |
| Coefficient of Thermal Expansion | 9.0 ppm/° F. (16.2 ppm/° C.) |
| Specific Heat (Heat Capacity) at 70° F. (20° C.) | 0.090 BTU/lb ° F. (377 J/kg K) |
| Specific Heat (Heat Capacity) at 212° F. (100° C.) | 0.093 BTU/lb ° F. (389 J/kg K) |
| Melting Temperature (Solidus) | 1695° F. (925° C.) |
| 0.2% Offset Yield Strength | 105 ksi (720 MPa) |
| Ultimate Tensile Strength | 115 ksi (790 MPa) |
| Tensile Elongation in 2 inches (50.8 mm) | 6% |
| Hardness | 30 HRC |
| $10^7$ Cycle Rotating Beam (R = −1/Fully Reversed) Fatigue Strength | 35 ksi (240 MPa) |
| Charpy V-Notch (CVN) Impact Strength | 15 ft lbs (20 J) |

Other particular alloys are copper-nickel-tin alloys containing from about 14 to about 16 wt % nickel, about 7 wt % to about 9 wt % tin, and the balance being copper. These alloys can be used in many different applications, including aerospace sleeves, spherical bearings, and industrial bearings. These alloys are beryllium free and exhibit excellent corrosion and stress corrosion cracking resistance in sea water, chlorides, and sulfides. Other properties are described in Table 2 below, again before the alloy is processed according to the present disclosure:

TABLE 2

| Properties of copper-nickel-tin alloy | |
|---|---|
| Elastic Modulus | $21.0 \times 10^6$ psi (144 GPa) |
| Density | 0.325 lbs/in$^3$ (9.00 g/cm$^3$) |
| Poisson's Ratio | 0.3 |
| Relative Magnetic Permeability | <1.01 |
| Electrical Conductivity | 7% IACS (4 MS/m) |
| Thermal Conductivity | 22 BTU/ft hr° F. (38 W/m K) |
| Coefficient of Thermal Expansion | 9.1 ppm/° F. (16.4 ppm/° C.) |
| Specific Heat (Heat Capacity) | 0.09 BTU/lb° F. at 70° F. (377 K/kg K at 20° C.) |
| Melting Range | 1740-2040° F. (950-1115° C.) |

Figure 2:
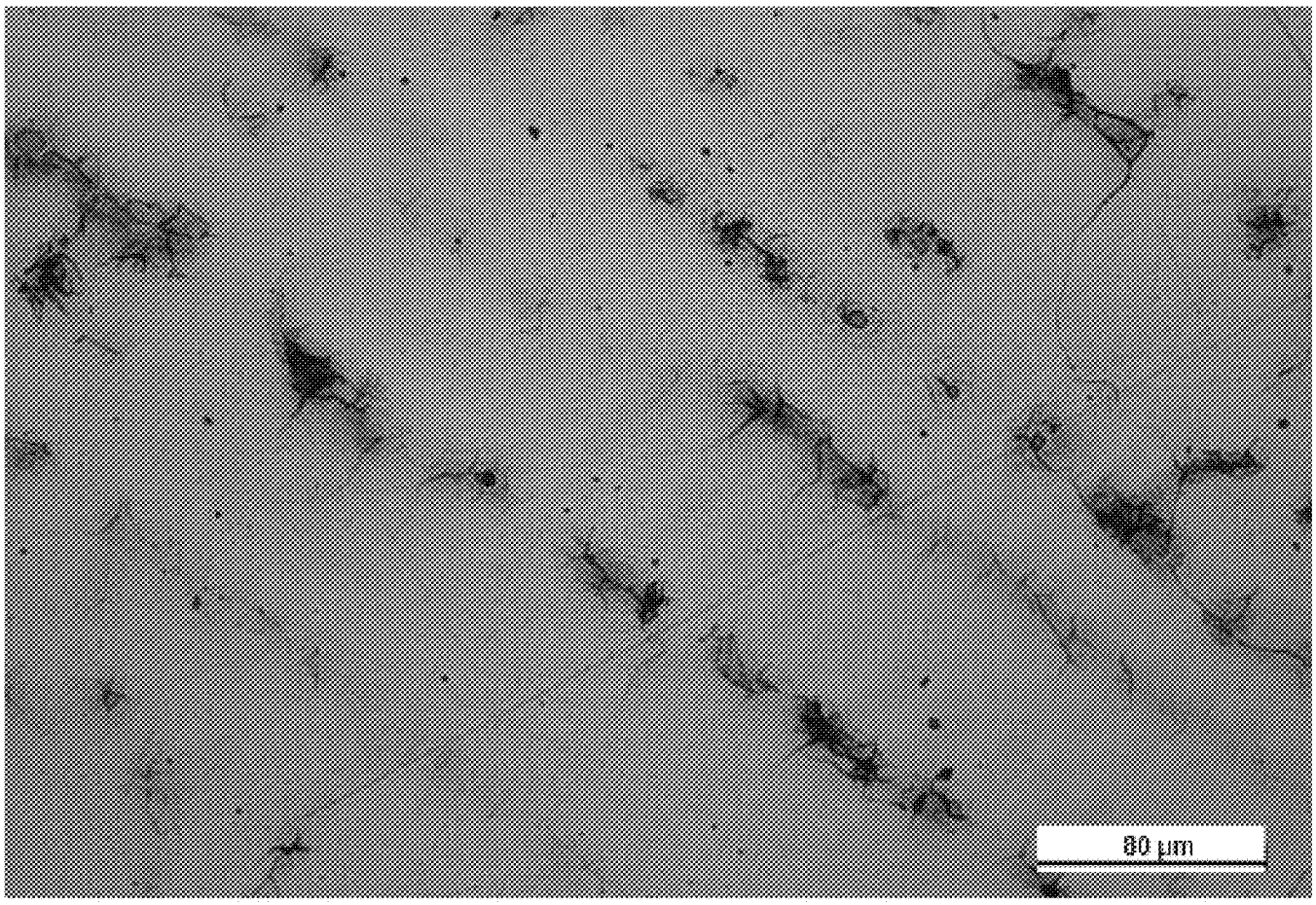
FIG. 2 is a micrograph of a casting prior to treatment as described herein.

FIG. 2 is a micrograph illustrating the as-cast condition for a Cu-15Ni-8Sn alloy. The structure shown exemplifies (a) uniformly fine dendrite arm spacing of less than 80 micrometers and very low amounts of compound formation within the dendrite arms, atypical for a high freezing range alloy such as this. This structure easily homogenizes under the high temperature and high pressure thermal treatments of the present disclosure, which are designed to further form a uniform composition state. The spinodal hardening results in the alloy having a variety of strengths and ductilities.

In some embodiments, the copper-nickel-tin alloy has at least 40% ductility and a 0.2% offset yield strength of at least 25 ksi. In other embodiments, the copper-nickel-tin alloy has a 0.2% offset yield strength of at least 96 ksi, an ultimate tensile strength of at least 113 ksi, and ductility of at least 2%. Such alloys can also have a Brinell hardness of at least 280. In more specific embodiments, the copper-nickel-tin alloy has a 0.2% offset yield strength of at least 100 ksi, an ultimate tensile strength of at least 120 ksi, and ductility of at least 7%, and a Brinell hardness of at least 280. In yet other embodiments, the copper-nickel-tin alloy has a 0.2% offset yield strength of at least 120 ksi. It is noted here that the ductility is synonymous with the percent elongation at break. These properties are measured according to ASTM E8.

The following examples are provided to illustrate the alloys, articles, and processes of the present disclosure. The examples are merely illustrative and are not intended to limit the disclosure to the materials, conditions, or process parameters set forth therein.

Examples

Measurement of mechanical properties was performed using specimens which were cast to shape and size in accordance with ASTM E8 governing tensile testing. Various alloys were cast by pressure assist casting and homogenization (i.e. thermal treatment) at 5000-15000 psi and a temperature of 1525° F. to 1675° F. The specimens were then spinodally decomposed at 700° F.-750° F. for a time of 1 hour to 5 hours, followed by air cooling. No further machining or surface preparation was performed. Table 3 lists the properties of these castings.

TABLE 3

| Class of Property | Sample | 0.2% offset yield strength (psi) | Ultimate tensile strength (psi) | Total elongation, % |
|---|---|---|---|---|
| High Strength | A | 128,300 | 129,100 | 7.1 |
| High Strength | B | 126,100 | 135,600 | 2.7 |
| High Strength | C | 121,400 | 128,100 | 2.9 |
| High Ductility | D | 26,400 | 60,300 | 41.4 |
| High Ductility | E | 27,300 | 65,400 | 42.4 |
| High Ductility | F | 27,500 | 65,000 | 50.4 |

Figure 3:
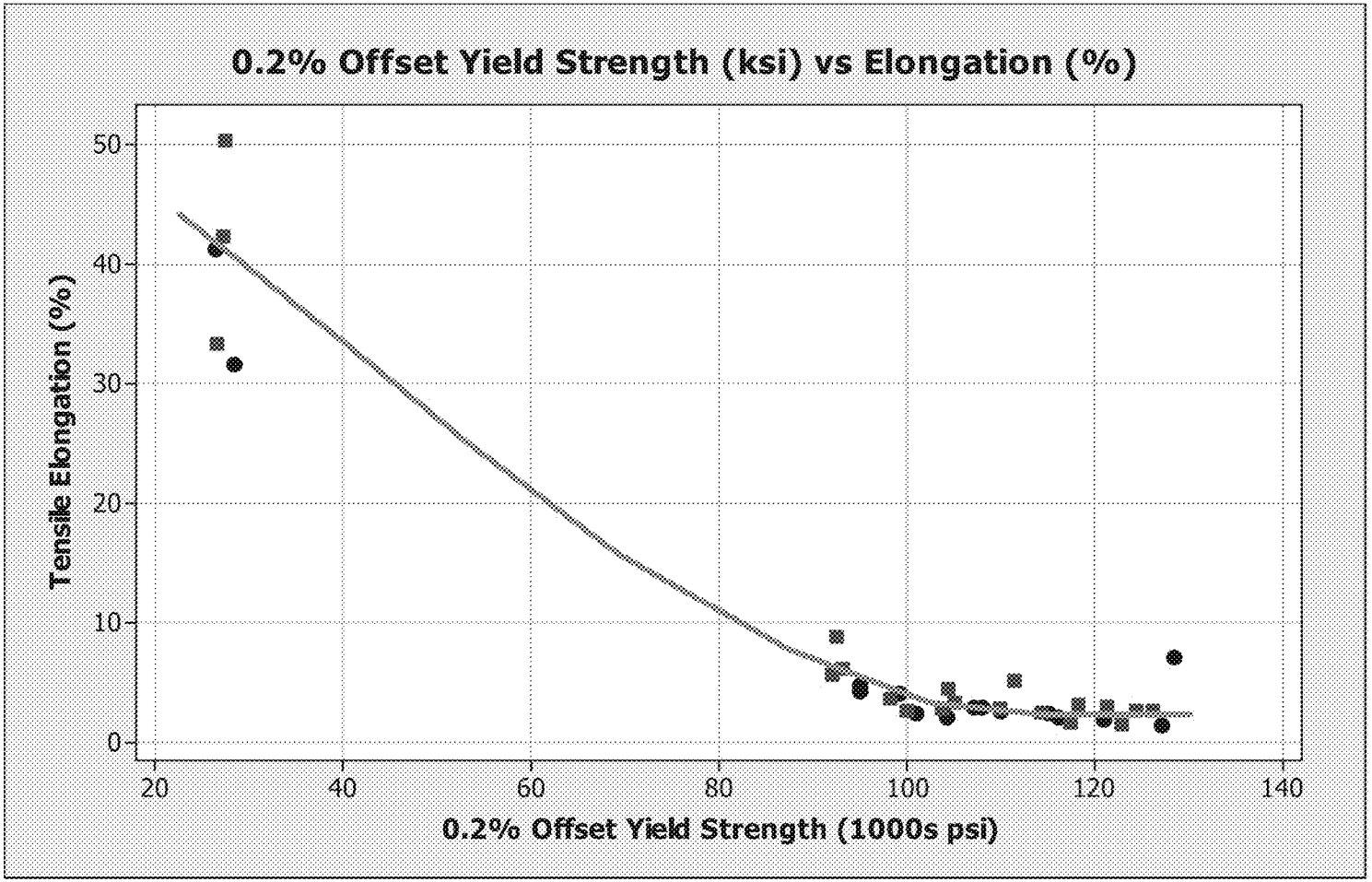
FIG. 3 is a graph showing the range of combinations of properties that can be obtained using the processes of the present disclosure.

Using various temperatures for spinodal decomposition, a unique spectrum of strength and ductility combinations can be achieved to enable selection of conditions that have useful tradeoffs for structural applications that require high strength or high toughness and elongation. FIG. 3 is a graph showing the range of responses to spinodal decomposition, which shows actual datapoints from samples subjected to a broad range of spinodal decomposition temperatures after casting and high pressure thermal treatment. The red squares represent samples having a reduced gauge section of 0.250 inches diameter, and the black circles represent samples having a gauge section of 0.350 inches diameter.

As seen here, there are two clusters. In the first cluster, the alloys have a tensile elongation (i.e. ductility) of about 30% to about 55% and a 0.2% offset yield strength of about 20 ksi to about 40 ksi. In the second cluster, the alloys have a tensile elongation of 10% or less, and a 0.2% offset yield strength of about 90 ksi to about 130 ksi.

The typical tensile elongation (i.e. ductility) is quite good, with 0.2% offset yield strength as high as about 130,000 psi. This reflects the benefits of the casting process creating a homogeneous microstructure coupled with proper high pressure homogenization and subsequent choices of spinodal decomposition temperature. Alternatively, very high ductility, approaching 50% elongation is achievable with lower strength as shown in the figure and table.

Proper engineering of the process can reliably produce articles with a target combination of properties. Table 4 provides an example of a Cu-15Ni-8Sn alloy cast as ASTM E8 tensile specimens with a desired target minimum of 100 ksi yield strength. Table 4 statistically describes the resultant property combination, which was very reliable for at least 10 lots of material cast on different days and with a number of molds and with varying lots in thermal processing. The variation is very low.

TABLE 4

| Mechanical Property | Average | Standard Deviation | Coefficient of Variation | Number of Samples/Tests |
|---|---|---|---|---|
| 0.2% Offset Yield Strength | 107.6 ksi | 3.2 ksi | 3.0% | 121 |
| Ultimate Tensile Strength | 124.5 ksi | 2.9 ksi | 2.3% | 121 |
| Total Elongation | 7.7% | 3.0% | 39.0% | 121 |
| Hardness (Brinell) | 285.4 | 5.6 | 2.0% | 58 |

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. An article comprising a copper-nickel-tin alloy, wherein the article is produced by a process comprising:
preparing a molten mixture of copper, nickel, and tin;
pressure assist casting the molten mixture to form a casting;
homogenizing the casting; and
shaping the casting to produce the article.

2. The article of claim 1, wherein the process further comprises: spinodally hardening the casting.

3. The article of claim 2, wherein the spinodal hardening is performed by solution annealing, quenching, and spinodal decomposition.

4. The article of claim 1, wherein the article is net-shaped or is an input billet.

5. The article of claim 1, wherein the alloy comprises from about 9 wt % to about 15 wt % nickel.

6. The article of claim 1, wherein the alloy comprises from about 6 wt % to about 8 wt % tin.

7. The article of claim 1, wherein the alloy comprises from about 9 wt % to about 15 wt % nickel and from about 6 to about 8 wt % tin.

8. The article of claim 1, wherein the molten mixture is prepared by gathering solid copper, nickel, and tin; and melting the gathered solid copper, nickel, and tin.

9. The article of claim 1, wherein the casting is homogenized by heating the casting at a temperature in the range of from about 1500° F. to about 1625° F. for a time period of from about 4 hours to about 24 hours.

* * * * *